US009555412B2

(12) United States Patent
Chou et al.

(10) Patent No.: US 9,555,412 B2
(45) Date of Patent: Jan. 31, 2017

(54) NANOFLUIDIC DEVICES FOR SINGLE-MOLECULE ANALYSIS OF PROTEIN-DNA COMPLEX

(71) Applicant: Academia Sinica, Taipei (TW)

(72) Inventors: Chia-Fu Chou, Taipei (TW); K. K. Sriram, Taipei (TW)

(73) Assignee: ACADEMIA SINICA, Taipei (TW)

( * ) Notice: Subject to any disclaimer, the term of this patent is extended or adjusted under 35 U.S.C. 154(b) by 640 days.

(21) Appl. No.: 14/048,539

(22) Filed: Oct. 8, 2013

(65) Prior Publication Data

US 2014/0120522 A1 May 1, 2014

Related U.S. Application Data

(60) Provisional application No. 61/718,552, filed on Oct. 25, 2012.

(51) Int. Cl.
*B01L 3/00* (2006.01)

(52) U.S. Cl.
CPC .. *B01L 3/502761* (2013.01); *B01L 2200/0663* (2013.01); *B01L 2300/0822* (2013.01); *B01L 2400/0415* (2013.01); *Y10T 29/49117* (2015.01)

(58) Field of Classification Search
CPC ..... B01L 3/502761; B01L 2200/0663; B01L 2300/0822; B01L 2400/0415; Y10T 27/49117; G01N 27/327–27/3274
See application file for complete search history.

(56) References Cited

PUBLICATIONS

Yeh, et al., "Entropy-Driven Single Molecule Tug-of-War of DNA at Micro-Nanofluid Interfaces", NANO LETTERS vol. 12, No. 3, Mar. 14, 2012, p. 1597-1602 + supporting information.*
T. Leichle & C.-F. Chou "Real-Time Sensing with Single-Pixel Resolved Kinetics Using Room-Temperature Bonded Biofunctional Nanoslits" Proceedings of the 6th IEEE International Conference on Nano/Micro Engineered and Molecular Systems, Feb. 20-23, 2011, p. 694-697.*
D. S. Latchman, Transcription factors: an overview, Int. J. Biochem. Cell Biol., vol. 29, No. 12, 1305-1312, (1997).
L. J. Guo, X. Cheng, C. F. Chou, Fabrication of Size-Controllable Nanofluidic Channels by Nanoimprinting and Its Application for DNA Stretching, Nano Lett., vol. 4, No. 1, 69-73, (2004).
J. Gu, R. Gupta, C. F. Chou, Q. Wei, F. Zenhausern, A simple polysilsesquioxane sealing of nanofluidic channels below 10 nm at room temperature, Lab Chip, vol. 7, 1198-1201, (2007).
Jan C.T. Eijkel and Albert Van Den Berg, Nanofluidics: what is it and what can we expect from it? Microfluid Nanofluid, vol. 1, 249-267, (2005).

(Continued)

*Primary Examiner* — J. Christopher Ball
(74) *Attorney, Agent, or Firm* — Brinks Gilson & Lione

(57) ABSTRACT

A device for optical mapping of protein binding sites, in particular, transcription factor binding sites, on single DNA molecules, includes an insulating substrate having two parallel channels and at least one slit connecting the two channels, a coverslip on the substrate, at least two reservoirs on the substrate connecting the channels of the insulating substrate, and at least two electrodes in the reservoirs. When the reservoirs are filled with a buffer solution, the electrodes are in electrical contact in the buffer solution.

16 Claims, 9 Drawing Sheets

(56) References Cited

PUBLICATIONS

Y. Harada, T. Funatsu, K. Murakami, Y. Nonoyama, A. Ishihama, T. Yanagida,Single molecule imaging of RNA polymerase-DNA interactions in real-time, Biophys J., vol. 76, 709-715, (1999).
Y. Ebenstein, N. Gassman, S. Kim, S. Weiss, Combining atomic force and fluorescence microscopy for analysis of quantum dot labeled protein-DNA complexes, J.Moi.Recognit, vol. 22, 397-402, (2009).
Yuval Ebenstein, N. Gassman, S. Kim, J. Antleman, Y. Kim, S. Ho, R. Samuel, S. Michalet, S. Weiss, Nanoletters, vol. 9, No. 4, 1598-1603, (2009).
T. T. Perkins, S. R. Quake, D. E. Smith, S. Chu, Relaxation of a single DNA molecule observed by optical microscopy, Science, vol. 264, 822-826, (1994).
C. Prinz, J. O. Tegenfeldt, R. H. Austin, E. C. Cox, J. C. Sturm, Bacterial chromosome extraction and isolation, Lab Chip, vol. 2, 207-212, (2002).
Massie, E. C.; Mills, G. I. ChiPping away at gene regulation. EMBO Rep. 2008, 9 (4), 337-343.
Ritort, F. Single-molecule experiments in biological physics: methods and applications J. Phys.: Condens. Matter 2006, 18, R531-R583. (4) Deniz, A.A.; Mukhopadhyay, S.; Lemke, E.A. Single-molecule biophysics: at the interface of biology, physics and chemistry J. R. Soc. Interface 2008, 5(18), 15-45.
Deniz, A.A.; Mukhopadhyay, S.; Lemke, E.A. Single-molecule biophysics: at the interface of biology, physics and chemistry J. R. Soc. Interface 2008, 5(18), 15-45.
Gueroui, Z.; Place, C.; Freyssingeas, E.; Berge, B. Observa-tion by fluorescence microscopy of transcription on single combed DNA Proc. Natl. Acad. Sci.U.S.A. 2002, 99 (9), 6005-6010.
Tegenfeldt, J.O.; Prinz, C.; Gao, H.; Huang, R.L.; Austin, R.H.; Chou, S.Y.; Cox, E.G.; Sturm, J.C. Micro- and nanofluidics for DNA analysis Anal. Bioanal. Chem. 2004, 378(7), 1678-1692.
Wang, Y. M.; Tegenfeldt, J.O.; Reisner, W.; Riehn, R.; Guan, X.J.; Guo, L.;Golding, 1.; Cox, E.G.; Sturm, J.; Austin, R.H. Single-molecule studies of repressor-DNA interactions show long-range interactions Proc. Natl. Acad. Sci.U.S.A. 2005, 102 (28), 9796-9801.
Blainey, P.C.; Oijen, A.M.V.; Banerjee, A.; Verdine, G.L.; Xie, X.S. A base-excision DNA-repair protein finds intrahelical lesion bases by fast sliding in contact with DNA Proc. Natl. Acad. Sci.U.S.A. 2006, 103(15), 5752-5757.
Kim, J.H.; Larson, R.G. Single-molecule analysis of 1D dif-fusion and transcription elongation of T7 RNA polymerase along individual stretched DNA molecules Nucleic Acids Res. 2007, 35 (11), 3848-3858.
Sanger, F.; Coulson, A.R.; Hong, G.F.; Hill, D.F.; Petersen, G.B. Nucleotide sequence of bacteriophage A. DNA J. Mol. Bioi. 1982, 162(4), 729-773.
Finn, R.D.; Orlova, E.V.; Gowen, B.; Buck, M.; Heel, M.V. *Escherichia coli* RNA polymerase core and holoenzyme structures EMBO J. 2000, 19(24), 6833-6844.
Hawley, O.K.; McClure, W.R. Compilation and analysis of *Escherichia coli* promoter DNA sequences Nucleic Acids Res. 1983, 11(8), 2237-2255.
Brodolin, K. Protein-DNA crosslinking with formaldehyde in vitro DNA-protein interactions: a practical approach, Oxford University Press 2000, Chapter 10, 141-149.
Bonthuis, D.J.; Meyer, C.; Stein, D.; Dekker, C. Confor-mation and dynamics of DNA confined in slitlike nanofluidic channels PRL 2008, 101(10), 108303.
Das, S.K.; Austin, M.D.; Akana, M.G.; Deshpande, P.; Gao, H.; Xiao, M. Single molecule linear analysis of DNA in nano-channel labeled with sequence specific fluorescent probes Nucleic Acids Res. 2010, 38 (18), e177.
Seong, G.H.; Niimi, T.; Yanagida, Y.; Kobatake, E.; Aizawa, M. Single-molecular AFM probing of specific DNA sequencing using RecA-promoted homologous pairing and strand exchange Anal. Chem. 2000, 72(6), 1288-1293.
Hou, X.M.; Zhang, X.H.; Wei, K.J.; Ji, C.; Dou, S.X.; Wang, W.C.; Li, M.; Wang, P.Y. Cisplatin induces loop structures and condensation of single DNA molecules Nucleic Acids Res. 2009, 37 (5), 1400-1410.
Ikeda, N.; Tanaka, N.; Yanagida, Y.; Hatsuzawa, T. On-chip single-cell lysis for extracting intracellular material Jpn. J. Appl. Phys. 2007, 46(9B), 6410-6414.
Yu, H.; Schwartz, D.C. Imaging and analysis of transcription on large, surface-mounted single template DNA molecules Anal Biochem. 2008, 380(1), 111-121.

* cited by examiner (a) (b)

(c) (d)

(a)

(b) (c)

(a) (b)

NANOFLUIDIC DEVICES FOR SINGLE-MOLECULE ANALYSIS OF PROTEIN-DNA COMPLEX

CROSS-REFERENCE TO RELATED APPLICATIONS

The present application claims the benefit of U.S. Provisional Application No. 61/718,552, titled "Nanofluidic Devices for Single-Molecule Analysis of Protein-DNA Complex", and filed on Oct. 25, 2012, which is incorporated herein by reference in its entirety.

TECHNICAL FIELD

The present disclosure is directed to devices for optical mapping of protein, in particular, transcription factor binding sites on single DNA molecules, and methods for preparing and using the same.

BACKGROUND

Transcription factors (TFs) are proteins that bind to specific bases of DNA to carry out the process of transcription. TFs play a major role in the process of transferring sequential information from DNA to RNA to protein. Thus, mapping TF binding sites becomes crucial in understanding the regulatory circuits that control cellular processes, such as cell division and differentiation as well as metabolic and physiological balance. Currently practiced techniques like chromatin immunoprecipitation (ChIP) are well established in TF binding site mapping.

In the recent years, single molecule techniques have a major contribution in the process of getting some insights on details at the molecular scale, which in general are not feasible with ensemble experiments. Various research groups have tried and reported TF binding site mapping using single molecule techniques like optical tweezers, atomic force microscopy, molecular combing etc.

SUMMARY

Devices for optical mapping of protein binding sites on single DNA molecules are disclosed. Methods for preparing and using the devices are also disclosed.

In one aspect, a device for optical mapping of protein binding sites includes an insulating substrate having two parallel channels and at least one slit connecting the two channels, a coverslip on the substrate, at least two reservoirs on the substrate connecting the channels of the insulating substrate, and at least two electrodes in the reservoirs so that when the reservoirs are filled with a buffer solution, the electrodes are in electrical contact in the buffer solution.

In another aspect, a method of preparing a device for optical mapping of protein binding sites includes steps of: providing an insulating substrate; forming two parallel channels on the insulating substrate; forming a slit on the insulating substrate connecting two parallel channels; forming at least two holes on the insulating substrate; covering the insulating substrate by a coverslip; attaching reservoirs to holes; and placing electrodes in the reservoirs.

BRIEF DESCRIPTION OF THE DRAWINGS

FIG. 1(*b*) shows the Atomic Force Microscopy (AFM) image of the nanoslit region, which is 200 μm in length, 10 μm in width and 50 nm in depth.

FIG. 1(*c*) is an optical microscope image showing a PSQ bonded device which has three nanoslits (shown in vertical lines) in the middle, connecting the microchannels (shown in horizontal lines).

FIG. 1(*d*) shows a schematic representation of stretched DNA-protein complexes in the presence of a small DC field in the nanoslit region.

FIG. 7(*b*) is the SDS-PAGE image showing all the subunits present in the *E. coli* RNA polymerase holoenzyme. The right most column shows the β' sub-unit of the RNA polymerase labeled with quantum dots (655 nm Anti-mouse IgG quantum dots, Invitrogen) using primary antibody (Mouse monoclonal antibody, WP001, Neoclone) as the linker. This experiment was conducted by transferring the Western blot results to a nitrocellulose membrane followed by the QD labeling reaction.

FIG. 9(*b*) shows the concept of high resolution QD localization, wherein a QD of around 15 nm sizes gives a point spread function comparable to its emission wavelength and the centroid co-ordinates can be obtained with greater precision using high-resolution localization method; Inset of FIG. 9(*b*) shows a single quantum dot.

DETAILED DESCRIPTION OF THE DISCLOSURE

This disclosure relates generally to nanofluidic devices and methods for optical mapping of transcription factor binding sites on single DNA molecules.

The present method adopts bio-conjugation, nanofluidic devices and fluorescence single molecule imaging for direct mapping of transcription factor binding sites on genomic DNA molecules. This method may resolve the protein binding site locations with nearly 100 nm resolution. The disclosed system could serve as a complementary technique to the currently existing methods practiced in the field.

Figure 1:
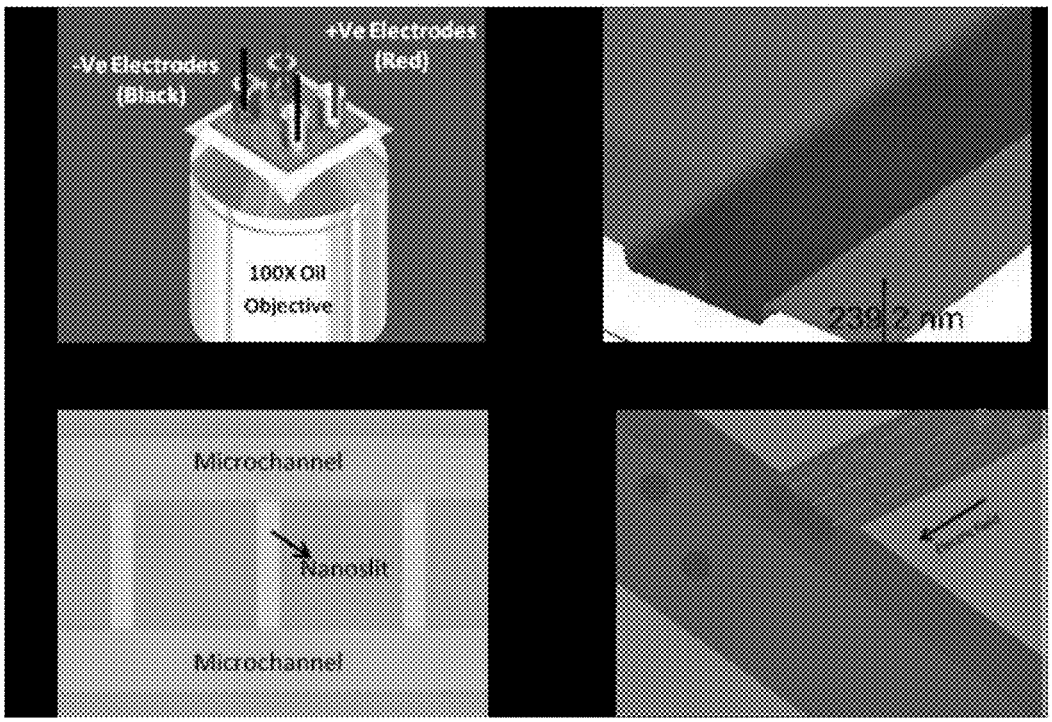
FIG. 1(*a*) shows a schematic representation of an experimental lay-out in one embodiment, wherein four gold electrodes are inserted into the reservoirs which are filled with buffer containing fluorescently labeled DNA-protein complexes, and a small DC voltage is applied to drive the DNA-protein complexes from the reservoirs to the nanoslit region, where they are observed using an inverted epifluorescence microscope.
Figure 2:
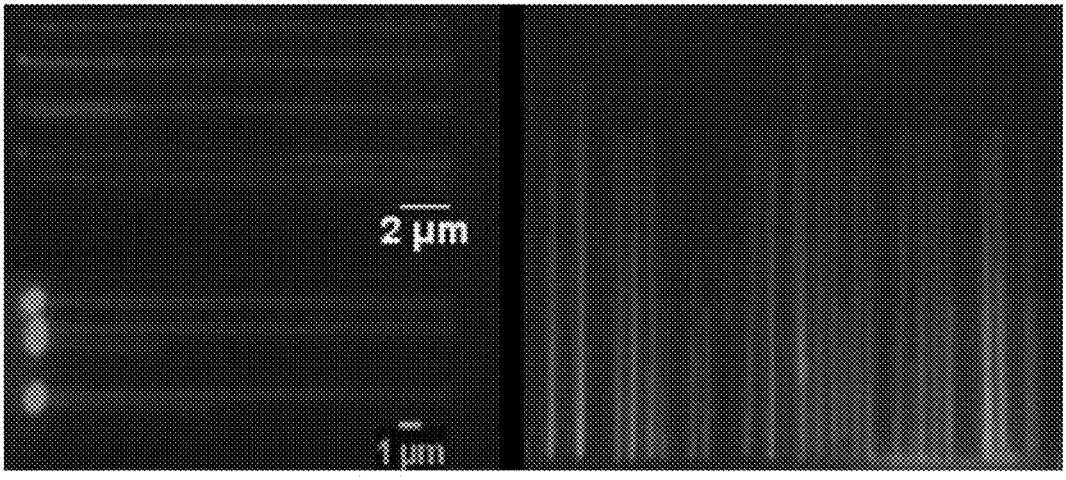
FIG. 2 shows fluorescence microscopy images showing end labeled λ-genomic DNA molecules; (a) shows that λ-genomic DNA molecules are labeled with 40 nm red transfluospheres (488 nm excitation/645 nm emission, Invitrogen Molecular Probes); (b) shows that λ-genomic DNA molecules are labeled with 200 nm green fluospheres (488 nm excitation/515 nm emission, Invitrogen Molecular Probes); (c) shows about 25 DNA molecules in the field of view. The DNA molecules are stretched in the nanoslit using an applied electric field.

FIG. 1 shows one embodiment of the present disclosure. A system is fabricated according to the description below. In general, the devices are fabricated on insulating substrates. In the present embodiment, a fluidic device was fabricated on fused silica substrates. H-shaped microchannels (100 μm in width and 1 μm in depth) and reservoirs were formed using UV lithography followed by inductively coupled plasma (ICP) etching. A second step UV lithography followed by reactive ion etching was carried out to define the nanoslits (200 μm long, 10 μm wide and 60 nm deep) across the H-shaped microchannels. Through holes were sandblasted to form loading holes and then the device was conformably sealed with a coverslip using a room temperature polymer (polysilsesquioxane) bonding technique. Polysilsesquioxane (PSQ) is a Si-based inorganic-organic polymer with a Young's modulus of 800 MPa, thus enabling high quality bonding for channels of aspect ratio less than $4\times 10^{-5}$. Briefly, PSQ was prepared by mixing xylene with Hardsil (Gelest Inc.) 2:1 ratio, filtered with a 0.45 μm PTFE membrane filter (Basic Life Inc.) and spun on a piranha (concentrated $H_2SO_4$ and $H_2O_2$ in 1:1 ratio) cleaned coverslip (No. 1 Goldseal). Then, the polymer was cured at 240° C. for 30 minutes. Both PSQ coated coverslip and piranha cleaned chips were exposed to oxygen plasma to enable strong bonding between chip and the PSQ coated coverslip. Finally, acrylic reservoirs were glued to the loading holes using UV curable glue. Gold electrodes in contact with the buffer solution filled in each of the four reservoirs forms the electrical contacts.

λ-phage is a bacterial virus that infects the bacterial species *Escherichia coli* (*E. coli*). It has a fully sequenced double stranded DNA with 48,502 base-pairs. λ-DNA has complementary, 12 base GC rich cohesive sticky ends, which enable them to circularize thereby preventing them from being degraded by host endonucleases. These 12 base sticky ends were ligated a complementary 12 base strand with biotin to one of the DNA ends (3' end in this case). These biotinylated DNA molecules were then coupled to streptavidin coated fluospheres. These fluospheres at DNA ends, which are slightly larger than the nanoslit depth, helped trapping DNA molecules at the micro-nano interface, where the DNA molecules were stretched in presence of an applied electric field. Moreover, they also served as a reference in mapping the positions of protein molecules bound along the DNA backbone. FIG. 2 shows fluorescence microscopy images showing end labeled λ-genomic DNA molecules. This system is not only limited to DNA molecules with sticky ends. Other DNA molecules with blunt ends (for example, T7 genomic DNA) can also be modified using a different approach, where biotin tags can be incorporated to the chosen DNA end using terminal deoxynucleotidyl transferase (TdT).

The present fluidic devices were applied for fluorescent single molecule studies using a model biological system and *E. coli* RNA polymerase holoenzyme (RNAP) complexed to λ-genomic DNA. *E. coli* RNA polymerase holoenzyme is a 450 KDa protein with 5 sub-units. σ sub-unit (σ70) is responsible for the sequence specific binding of these proteins to the DNA molecules. The promoter binding sites for RNAP along λ-genomic DNA are well known. Previous works have shown the presence of two strong promoters PR and PL and various pseudo-promoters (regions that closely match the promoter sequence) in λ-genomic DNA.

In the present disclosure, RNAP molecules were labeled with quantum dots (QDs) through a primary antibody (AB)—secondary anti-body coupling scheme. A primary antibody (Mouse monoclonal, WP001, Neoclone) that binds specifically to one of the sub-units of RNAP was chosen. Then, a QD (655 nm Anti-mouse IgG, Invitrogen) with a secondary antibody against the chosen primary antibody was used. AB-QD complexes were prepared by mixing AB and QD in 1:1 ratio. Meanwhile, DNA-RNAP complexes were prepared separately using formaldehyde crosslinking mechanism. After this step, DNA-RNAP complex solution was mixed with AB-QD complex solution to label the RNAP molecules. Finally, the whole complex was diluted in observation buffer (0.5×TBE, 10% (w/v) glucose, 2.5% (w/v) PVP, and 0.1% (v/v) Tween 20) containing an oxygen scavenging system (50 μg/ml glucose oxidase, 10 μg/mL catalase and 0.5% (v/v) β-mercaptoethanol) and DNA molecules were labeled with YOYO-I nucleic acid stain (1:5 dye:base-pair ratio) prior to loading of sample in the reservoirs of the fluidic devices. The DNA concentration in the final solution was about 0.1 ng/μL.

Figure 3:
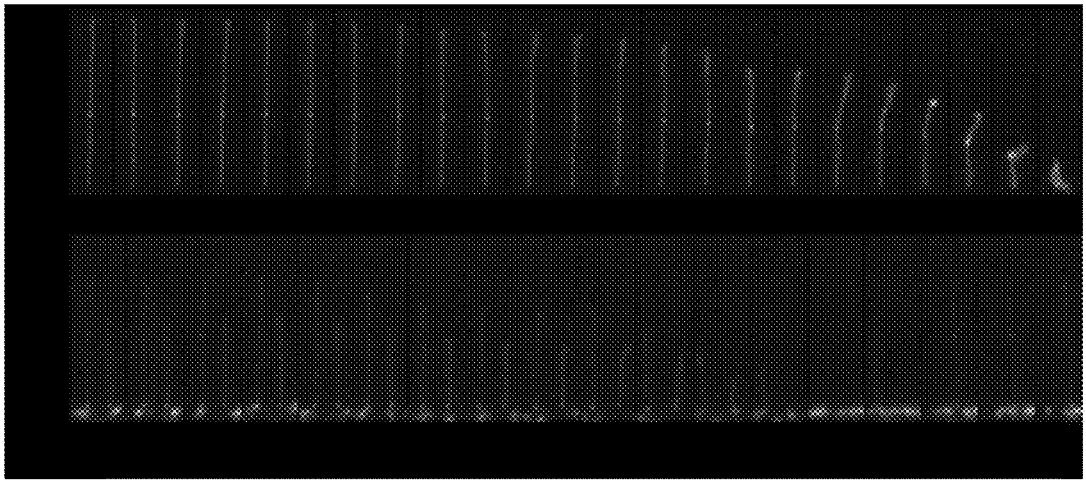
FIG. 3 shows time-lapse images showing the stretching and recoiling of λ-genomic DNA with bound QD-labeled *E. coli* RNAP complex by applied electric field in the nanoslit.

Once the fluidic channels were filled with buffer containing fluorescently labeled DNA-protein complexes, a small voltage drop was applied across the microchannels to drive the DNA-protein complexes towards the nanoslit region. Then, a voltage drop was applied across the nanoslits. Those DNA molecules which have end labeled fluospheres were trapped in the micro-nano interface. Others normally passed through the nanoslit to reach the opposite end of the microchannels. The trapped DNA molecules were stretched into the nanoslit region in presence of the small voltage drop applied across the nanoslits. FIG. 3 shows time-lapse imaging, indicating the stretching of λ-genomic DNA (Green) with bound QD-labeled *E. coli* RNAP complex (Red) by applied electric field in the nanoslit.

In the embodiment shown in FIG. 1(*c*), there are three parallel nanoslits in the device. These nanoslits are arranged in such a way that only one of the nanoslits is in the field of view during observation (using 100× oil objective). Each slit is 10 μm wide and can have 20-30 DNA molecules fairly separated from each other during each observation. All DNA molecules are arranged parallely with a common reference point (micro-nano interface). Thus, the present system facilitates multiplexing. Also, the nanoslits are 200 μm long, which enables long genomic DNA experiments. The applied electric field and the confinement effect from the nanoslits make it possible to achieve about 87% stretching of DNA molecules. Earlier work from Perkins et. al, using a similar system to stretch DNA molecules in nanoslits also shows similar stretching rates.

Figure 4:
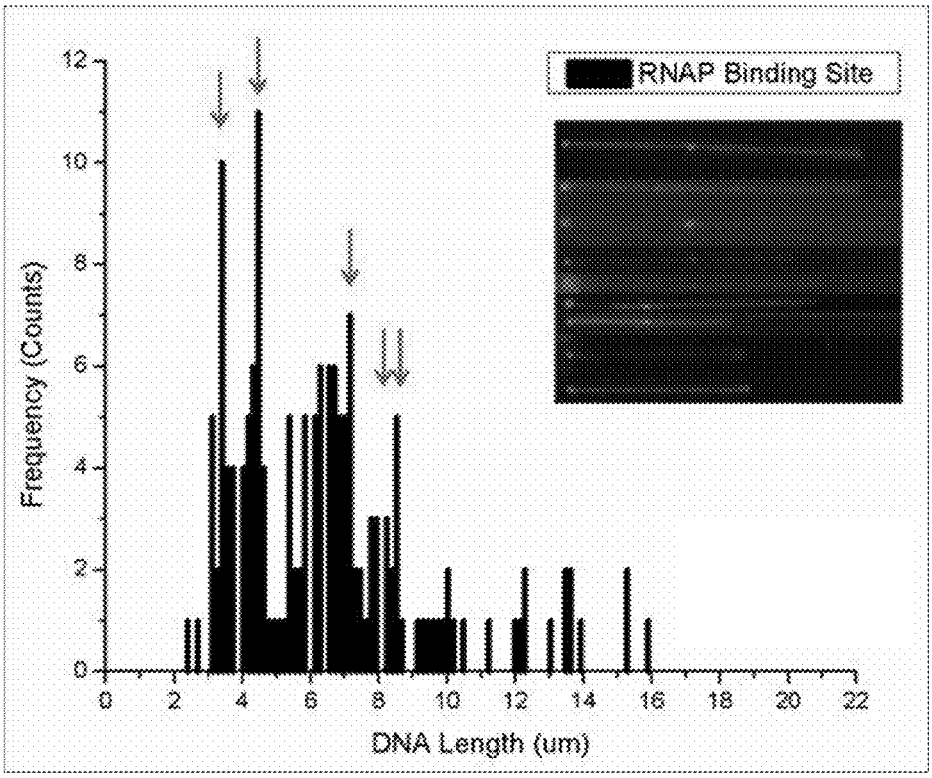
FIG. 4 shows localization of RNAP molecules bound to λ-genomic DNA stretched in the nanoslit. Histogram shows the values (about 160 molecules) are in good agreement with known promoter (3.6 and 4.4 μm) and pseudo-promoter (7.3, 8.2 and 8.5 μm) regions of *E. coli* RNAP holoenzyme. 3.6 μm and 4.4 μm regions correspond to the PR and PL promoter regions of λ-genomic DNA. These measurements were carried out with the 3' end of the λ-genomic DNA (streptavidin fluosphere is bound to the 3' end) as the reference point. Inset shows assorted images of DNA-RNAP complexes with all five binding sites.

Fluorescence was excited (Leica DMI 4000-B) when light from a mercury lamp passes through appropriate filters (470/40 nm band-pass/585 nm dichroic/655/40 nm long-pass filter), a 100× oil lens (Plan-Apo, 1.4 N.A.) and an additional magnifier (1.6×), exciting fluorescently labeled DNA and RNAP molecules. Photons emitted were collected over multiple frames using an EMCCD (Ixon 897, Andor) with high quantum efficiency. A split view system (488 nm band-pass/585 nm dichroic/655 nm long-pass filter, Optical Insights) was placed in front of the EMCCD to split the signal from DNA (Green) and end labeled fluospheres and QDs (Red). Most of the previously reported works related to single molecule DNA-protein complex studies have used total internal reflection fluorescence (TIRF) system in their experiments, to achieve a better signal-to-noise ratio. Here, the disclosed fluidic device with sub-100 nm depth helps to achieve better signal-to-noise ratio with a regular epi-fluorescence microscope. After the experiment conditions were optimized in terms of fluidic device fabrication and DNA-RNAP complex formation, the experiments were repeated to get statistical data from the experiments. Images were collected and analyzed and a histogram is plotted with results from about 160 DNA-RNAP complexes. The plot was done with DNA length in μm along X-axis and frequency along Y-axis (shown in FIG. 4).

The histogram plot shows that these results are in accordance with the expected RNAP binding sites along genomic λ-DNA back-bone. The data show that binding events are more frequent for the strong promoter regions, PL and PR in comparison to the pseudo-promoters, which are promoter like sequences. Some of the earlier single molecule methods for studying DNA-RNAP complexes like molecular combing or AFM studies are not capable of distinguishing protein/QD localized over the DNA back-bone from a real DNA-protein complex. The system in the present disclosure is able to distinguish real binding events from such events by stretching and recoiling DNA molecules using a small electric field, thereby avoiding any false positive results.

Figure 5:
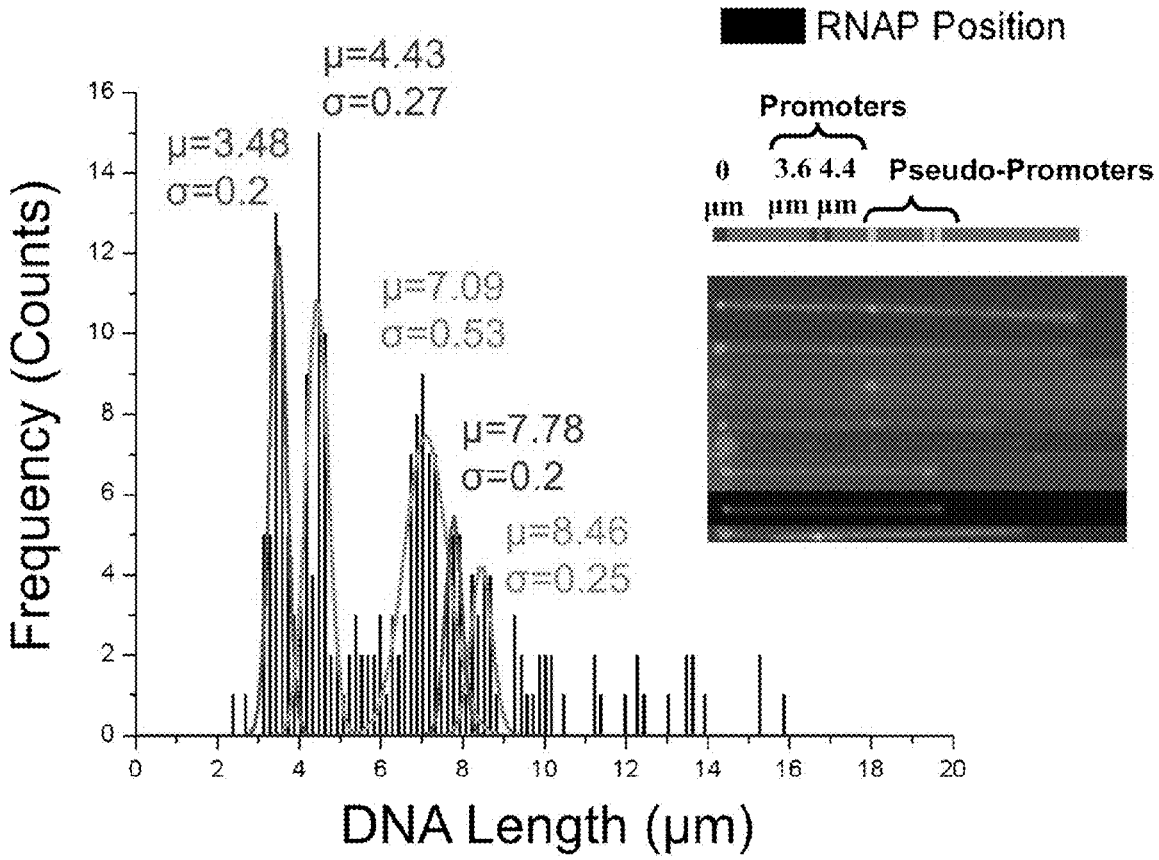
FIG. 5 shows histograms of all analyzed DNA molecules with Gaussian fit. The obtained fit for PR and PL promoter regions show that the present method can identify the RNAP binding site with about 100 nm resolution. The results also indicate that the strong promoter regions (3.6 and 4.4 μm) show a narrow distribution when compared to the pseudo-promoter regions (7.3, 8.2 and 8.5 μm).

A 2D Gaussian fit of the obtained histogram shows that the strong promoter binding sites PL and PR can be determined with nearly 100 nm resolution. Pseudo-promoters show a much broader distribution for the 7.3 μm region and not many events were seen in case of the 8.2 and 8.5 μm regions (shown in FIG. 5). Presence of end labeled fluospheres is surely advantageous from the point of view of mapping binding site locations as it serves as a reference to identify the orientation as well as in improving the mapping resolution. Earlier works from other groups have shown that using some reference tags along the DNA backbone can help to improve the mapping resolution. The present disclosure focuses on a device that can serve the purpose of TF binding site identification.

The fluidic device in the present disclosure can be used for effective identification of TF binding sites along field stretched genomic DNA molecules. The results show that the device is suitable for both multiplexing and individual events. The system is able to map TF binding sites with about 100 nm resolution without the need of using any sophisticated optical setup like TIRF microscopy. Also, DNA stretching/recoiling using electric field helps to distinguish real DNA-protein complexes from false positive events. This device is not only confined to TF binding site mapping, but can be used for studies like mapping nicking sites, RecA promoted homologous pairing and strand exchange, cisplatin induced DNA condensation etc along with stretched genomic DNA molecules. Moreover, the device also opens up the possibility for a lab-on-chip device in which in-vivo complexed DNA-protein samples can be extracted from a cell and protein-binding sites mapped. This system can be used for simple and quick analysis in related fields, serving as a potential complementary technique.

Experimental Methods

The detailed description of the experimental procedures are described with reference to the below examples.

Device Fabrication

The micro-nano fluidic channels were fabricated on fused silica wafers (Semiconductor Wafers Inc.) using standard photolithography and dry etching techniques. Photolithography was carried out in two steps to obtain the micro and nano features. Microchannel features defined by first step UV exposure (S1813 positive photoresist spun at 4000 rpm for 25 seconds, baked at 110° C. for 90 seconds, UV exposed at W power for 5.2 seconds and developed using MF319 photoresist developer for 15 seconds) were etched using Inductively Coupled Plasma (ICP, RIE-0ip, Samco) machine. A mixture of $CHF_3/CF_4/O_2/Ar$ gases at flow rates 50/33.3/6.7/30 sccm and bias/RF power 700/300 W were used for 2 minutes and 30 seconds. Surface profiler (Alpha step IQ, KLA Tencor) measurements confirmed features of depth around 1 μm.

Nanoslit features defined by second step UV exposure were etched using a Reactive Ion Etching (RIE Plasmalab 80+, Oxford Instruments) machine. An initial de-scum process using 100 sccm $O_2$, 300 mTorr pressure and 150 W RF power for 3 minutes to remove any residual photoresist layer in the nanoslit regions is followed by etching using $CHF_3/O_2$ mixture at flow rates 85/6 sccm, pressure 100 mTorr and RF power of 70 W for 8.5 minutes. Surface profiler and Atomic Force Microscopy (Nanoscope III, Veeco) measurements showed nanoslit depths around 60 nm.

Above mentioned fabrication steps were carried out on a 4" fused silica wafer to facilitate batch processing. Each fluidic device is 14 $mm^2$ and thus a 4" wafer can yield nearly 25 working chips. The 4" wafer was subjected to dicing to obtain individual fluidic devices. Then, loading holes were drilled using a sand blaster and the devices bonded using PSQ room temperature bonding process. Finally, loading reservoirs were glued to the substrate using UV curable glue (Norland optical adhesives). With this, the device is complete and ready for experiments.

PSQ Bonding Details

Figure 6:
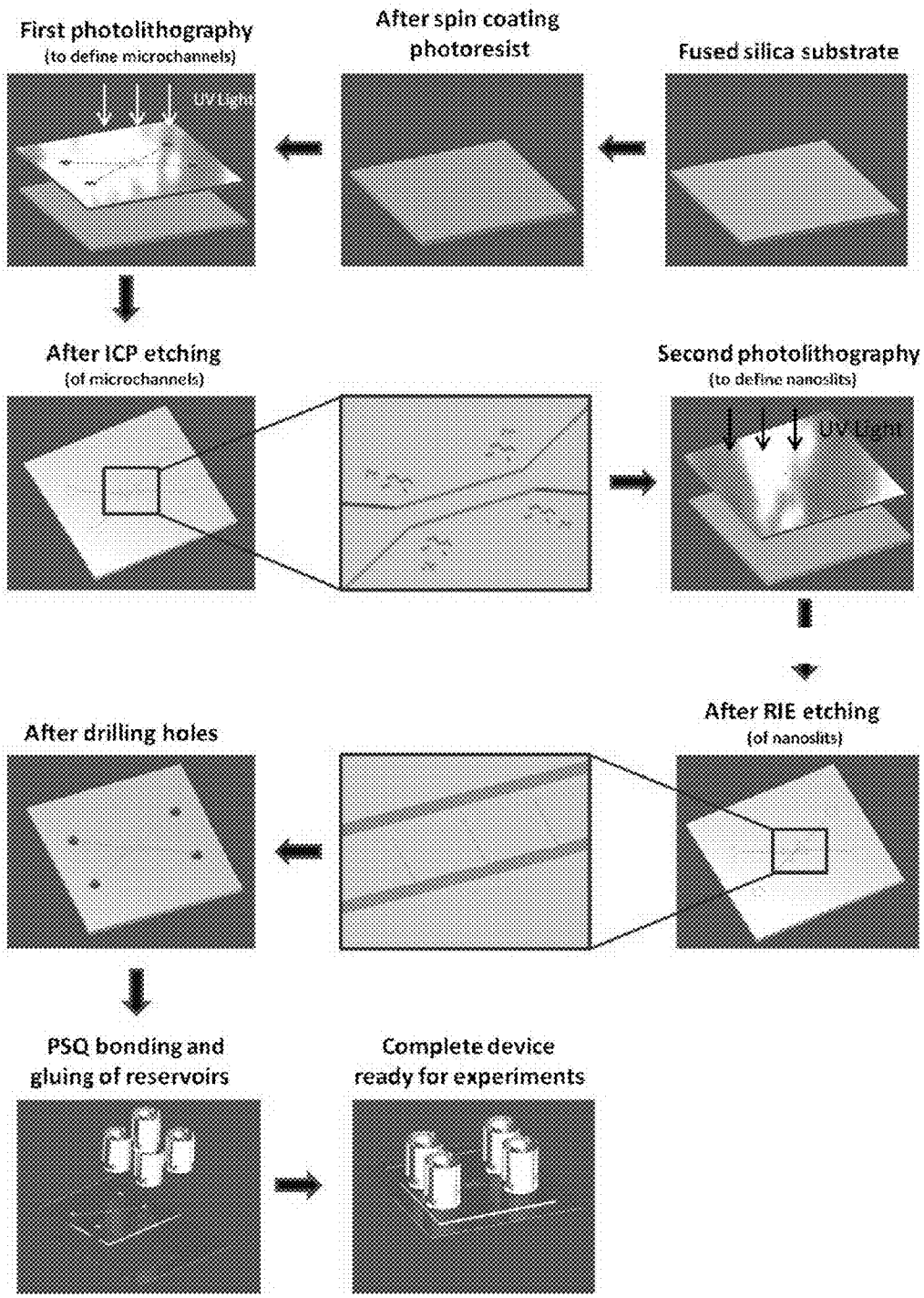
FIG. 6 shows fabrication process flow of nanoslit devices in one embodiment.

Each chip was then bonded using a glass coverslide coated with polysilsesquioxane (PSQ) polymer layer. Fabricated chips were thoroughly cleaned using acetone/IPA/de-ionized water and dried. Glass coverslides (No. 1 gold seal, 25 $mm^2$) and chips were then subjected to piranha cleaning (Concentrated $H_2SO_4$ and $H_2O_2$ in 1:1 ratio) for 15 minutes to render the surface hydrophilic. PSQ solution was freshly prepared before experiments by mixing xylene and Hardsil (AP grade, Gelest Inc.) in 2:1 ratio. This mixture was then filtered using a 0.45 μm PTFE membrane (Basic Life Inc.). Piranha cleaned coverslides were coated on one side with PSQ (3000 rpm for 30 seconds) and baked at 240° C. for 30 minutes. Then, the PSQ coated surface and the fluidic chips were subjected to $O_2$ plasma (17 sccm $O_2$, 50 W RF power, 0.18 mbar pressure) for 1 minute. The PSQ coated surface was placed on top of the fluidic device and a small pressure was applied using tweezers to facilitate smooth bonding. Fabrication process flow of nanoslit devices was shown in FIG. 6. Schematic representation of the experimental layout was shown in FIGS. 1 (*a*) and (*b*).

SDS-PAGE and Western Blot Experiments

SDS-PAGE experiments were done to check the quality of the RNAP samples before experiments. Later, Western Blot experiments were conducted to see if chosen primary antibody can complex with the RNAP.

SDS-PAGE Experiments

A 6% polyacrylamide gel was used for this experiment. 5.3 mL distilled $H_2O$, 2 mL of 30% acryl-bisacrylamide mix, 2.5 mL of 1.5 M Tris pH 8.8, 0.1 mL of 10% SDS, 0.1 mL of 10% ammonium persulfate and 0.008 mL TEMED were mixed in the above mentioned order. This solution was poured into a rack (0.75 mm thick, BioRAD) to ¾th of the rack. Alcohol was sprayed on top to avoid evaporation of solution and the gel was allowed to set for around 30 minutes at room temperature. This layer forms the running gel. Any remaining alcohol was drained and a mixture of 3.4 mL $H_2O$, 0.83 mL of 30% acryl-bis acrylamide mix, 0.63 mL of 1.5 M Tris pH 6.8, 0.05 mL of 10% SDS, 0.05 mL of 10% ammonium persulfate and 0.005 mL TEMED was poured to cover the remaining ¼th of the rack. A plastic comb was placed to define the lanes. Again, the gel was allowed to set for 30 minutes at room temperature. This second layer formed the stacking gel.

SDS-PAGE experiments were run using 1× running buffer (Tris/Glycine/SDS buffer 10× stock, #161-0732, BioRAD). Sample was prepared by mixing 1 μL *E. Coli* RNA polymerase holoenzyme (0.5 μg) with 2.5 μL of 6× sample buffer and 6.5 μL of Tris buffer, 20 mM, pH 8.0 to obtain 10 μL total volume. This sample was mixed well and heated at 100° C. for 10 minutes using a heating block followed by a quick spin to denature the proteins. The gel was placed in the column and filled with 1× running buffer. 10 μL of the RNAP sample prepared was loaded into one of the lanes and one lane on either side was filled with a protein marker. Electrodes were connected and the gel was allowed to run at 200 V, 400 mA for 45 minutes. The gel was then allowed to soak in coomassie blue stain for 30 minutes and the results were obtained.

The results showed two distinct bands around 175 KDa which matches with the size of β and β' sub-units of *E. Coli* RNA polymerase holoenzyme. Clear band around 80 KDa was confirmed to be σ sub-unit and a band for σ sub-unit was observed. These results also match with the datasheet provided by the supplier (Epicentre Biotechnologies). Presence of σ sub-unit confirms that the product used was a holoenzyme (Core enzymes of *E. Coli* RNA polymerase lack σ sub-unit).

Western Blot Experiments

RNAP sample was prepared and SDS-PAGE experiment was done using the protocol described above. After this step, the gel was soaked in 1× transfer buffer (Tris/Glycine buffer, #161-0734, BioRAD) for 1 hour at room temperature. In a separate container, filter papers and nitrocellulose (NC) membrane for Western Blot experiments were also soaked in 1× transfer buffer for 1 hour at room temperature. Membrane transfer process was carried out at 24V for 1 hour to transfer the information from the gel to the NC membrane. Then, membrane was washed with distilled $H_2O$ and then soaked in blocking buffer (1×PBS, 0.1% v/v Tween-20, 5% w/v non-fat milk powder) at room temperature for 1 hour, with constant shaking. Then, NC membrane was washed in 1×PBST buffer (1×PBS, 0.1% v/v Tween-20).

10 μL of primary antibody (Mouse monoclonal, WP001 clone, specific to β' sub-unit, Neoclone Biotech) was added to 10 mL blocking buffer (1000 times diluted) and NC membrane was soaked in this solution and allowed to sit at 4° C. overnight with constant shaking. Then, NC membrane was washed in 1×PBST buffer to remove any unbound primary antibody. 4 μLI of 1 μM QDs (Qdot 655 goat $F(ab')_2$ anti-mouse IgG conjugate H+L, Q11022MP, Invitrogen) were added to blocking buffer and NC membrane was soaked for 1 hour at room temperature, with constant shaking. Then, the membrane was taken out and washed again in 1×PBST buffer to remove any unbound QDs. Later, results were observed using a UV-transilluminator. A sharp red band observed around 175 KDa showed that the primary antibody was capable of binding to the β' sub-unit of the RNAP as expected.

Figure 7:
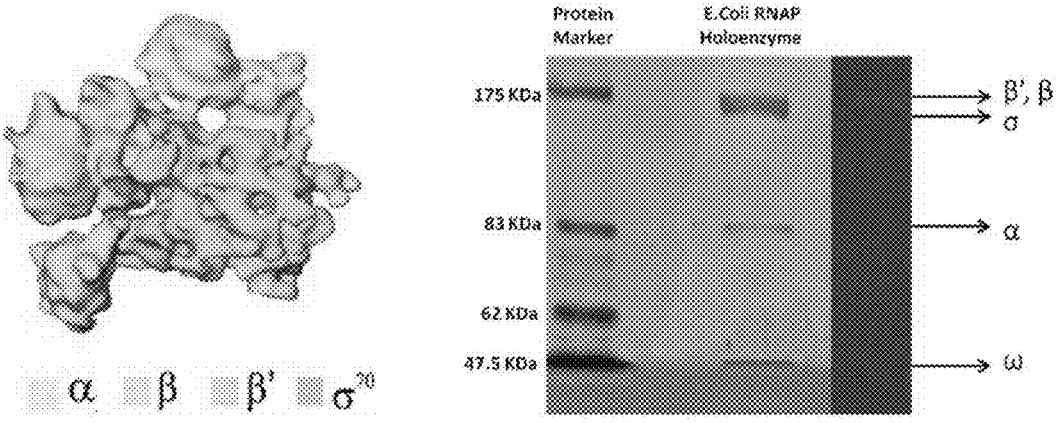
FIG. 7(*a*) shows a three dimensional view of *E. coli* RNA polymerase holoenzyme adopted from work done by Finn, R. D et. al.

FIG. 7 (*a*) shows a three dimensional view of *E. coli* RNA polymerase holoenzyme (Figure adopted from work done by Finn, R. D et. al). FIG. 7 (*b*) shows all the subunits presented in the *E. coli* RNA polymerase holoenzyme. The right most column shows the β' sub-unit of the RNA polymerase labeled with quantum dots (655 nm Anti-mouse IgG quantum dots, Invitrogen) using primary antibody (Mouse monoclonal antibody, WP001, Neoclone) as the linker. This experiment was conducted by transferring the Western blot results to a nitrocellulose membrane followed by the QD labeling reaction.

Gel-Shift Assay

Gel shift assay was done to optimize the conditions for DNA-RNAP complex formation. A shift assay including the primary antibody and secondary antibody conjugated QD was also done to get some insights on DNA-RNAP-AB-QD complex formation conditions.

A 310 base-pair PCR fragment with PR promoter region (37974-38032 bases from the 5' end) was used for these experiments. 1% Agarose gel in 1×TBE buffer was used in all experiments. 1 μL of 310 base-pair PCR product (110 ng/μL) was mixed with 0.5 μL of RNAP (0.5 μg/μL) in 2 μL of 5×CLB buffer (0.25 M HEPES-NaOH pH 8.0, 0.5 M NaCl, 25 mM $MgCl_2$, 25% glycerol) in a total volume of 10 μL. Two controls were prepared with no DNA molecules in one and no RNAP molecules in the other. First, all the solutions were incubated at 37° C. for 15 minutes. Then, 1 μL of 37% formaldehyde (F8775, Sigma Aldrich) was added to the above solution, mixed gently and incubated at 4° C. for 30 minutes. Formaldehyde reaction was quenched by adding equal amounts of tris buffer. DNA markers were loaded on the lanes at the extremities and sample 1 (DNA alone) was loaded in lane 1, sample 2 (RNAP alone) was loaded in lane 2 and sample 3 (DNA-RNAP complex) was loaded in lane 3. The lane loaded with DNA-RNAP mixture showed a shifted band which confirmed the formation of complexes.

Figure 8:
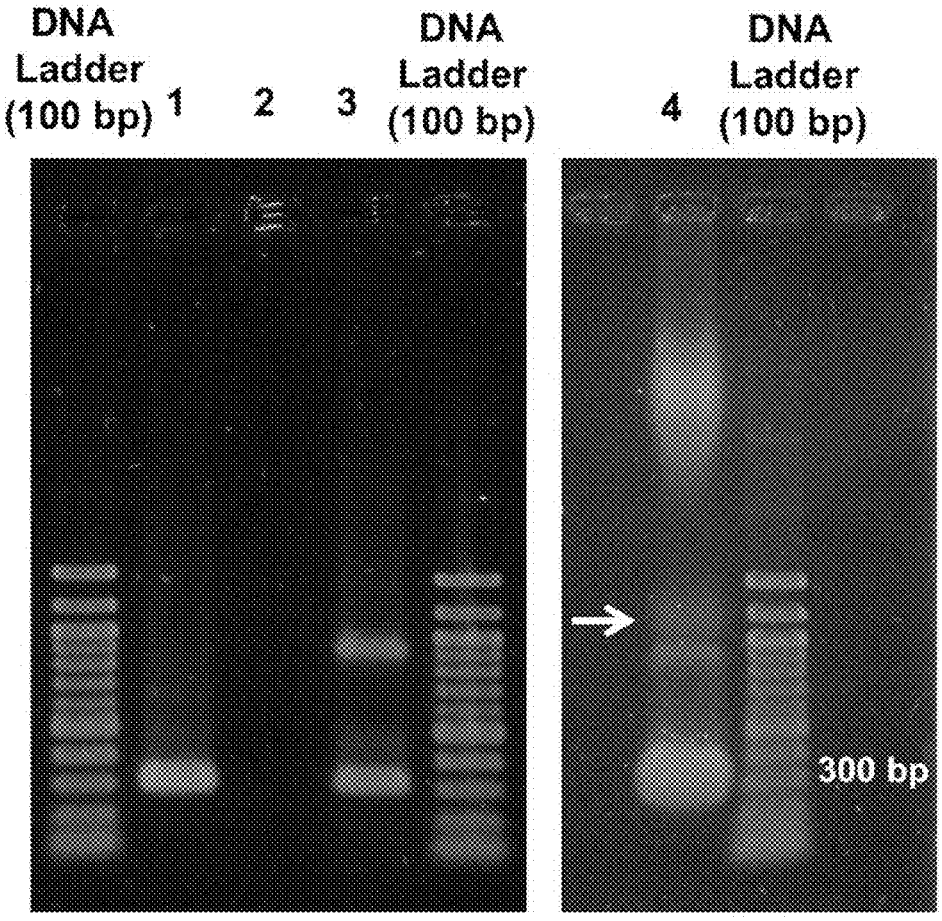
FIG. 8 shows that gel-shift assay confirms the formation of DNA-protein complexes.

A similar assay was done with 0.5 μL of AB-QD complex (0.5 μM) added to the DNA-RNAP complex and incubating it at room temperature in a dark place for 45 minutes. Results showed a band for the QDs in a similar position as the shifted band for DNA-RNAP complex alone. There were some non-specific complexes too, but the results from the specific complexes were distinct from the non-specific ones. FIG. 8 shows that gel-shift assay confirms the formation of DNA-protein (RNAP holoenzyme) complexes, in which Lane 1: DNA alone (310 base pair PCR product with PR promoter region; Lane 2: *E. coli* RNAP holoenzyme alone; and Lane 3: DNA+*E. coli* RNAP holoenzyme complex. Results in Lane 4 (indicated by arrow) of the gel show super-shift assay results for DNA-RNAP holoenzyme complex labeled with a quantum dot through primary antibody-secondary antibody complex scheme.

Sample Preparation

Fluosphere End Labeling of λ-Genomic DNA

This process involves multiple steps like ligation of biotinylated primers to DNA ends, removal of unbound oligonucleotides and binding streptavidin fluospheres to biotinylated DNA molecules. A method similar to that of Perkins et. al. was used. All the steps are discussed in detail here.

Ligation of Biotinylated Primers to λ-DNA

λ-DNA has complementary, 12 base pair overhanging sections at each end. The end of the DNA molecule was labeled with a fluosphere. This fluosphere labeling can help trap the DNA molecules in the micro-nano interface, thus stretching the DNA molecule in the nanoslit region, in presence of an applied electric field. Moreover, it facilitates DNA orientation identification and RNA polymerase mapping with improved resolution.

λ-genomic DNA used in the experiments was purchased from NEB. The reported stock concentration of the DNA is 500 ng/μL. 12 base pair biotinylated oligonucleotides, complementary to the 3' end of the λ-genomic DNA were purchased from MDBio Inc., Taiwan. An aluminum heating block is pre-heated to 65° C. 50 μL of λ-genomic DNA (500 ng/μL, NEB) was mixed with 40 μL of biotinylated oligonucleotides (100 μM, MDBio Inc.) in presence of ligase buffer (10× concentrations, NEB) in 400 μL reaction volume.

Above mentioned solutions were mixed gently using a pipette with wide opened tips to avoid DNA fragmentation. Then, the mixture was incubated at 65° C. for 5 minutes. Later, it was allowed to sit at room temperature for few hours to allow addition of oligonucleotides to the DNA ends. DNA ligation was carried out by adding 2 μL of DNA ligase (NEB) and 4 μL of 0.1M ATP to this solution and incubating it at 16° C. overnight. After the ligation step, the solution was heated again at 65° C. for 10 minutes to inactivate the ligase and unhybridize any nonligated oligonucleotides, which were removed in the following step.

Removing Unbound Oligonucleotides

The unbound oligonucleotides from the previous step were removed as it would interfere with the fluosphere labeling step in the next step. The reason is that these oligonucleotides are much smaller compared to the ligated λ-genomic DNA molecules and can diffuse faster, thereby binding more easily to the streptavidin sites in the fluosphere, thus reducing the DNA end labeling efficiency.

A 100,000 MWCO centrifugal filter (10 mL, Amicon Ultra4, Millipore) was used for this purpose. 1×TE buffer was used in this process. First, 1 mL 1×TE buffer was added to the filter. Then, another 1 mL 1×TE buffer with 1 μL BSA (10 mg/mL, NEB) was added and the column is centrifuged at 2750 g for 4 minutes at 25° C. (Z 300K, Hermle). The filter was taken out, replaced with 1×TE buffer up to the 2 mL mark of the filter and the centrifugation process was carried out for two more times with the above mentioned conditions.

After this step, the filter was filled with 1 mL of 1×TE buffer; ligation solution was added to it slowly using a pipette with wide opened tip. The filter was then filled to the 2 mL mark and centrifuged at 1000 g for 16 minutes at 25° C. Such slow speeds are used to avoid shearing of genomic DNA molecules. The solution that was drained to the bottom of the filter was removed and the filter was filled with fresh 1×TE buffer to the 2 mL mark. This process was repeated seven times to ensure maximum removal of unbound oligonucleotides.

The final solution retained at the top of the filter was collected and the DNA concentration was measured using a spectrophotometer (NanoDrop, Thermo Scientific) to ensure that the DNA concentration is adequate for the following steps.

Labeling Biotinylated λ-Genomic DNA with Fluospheres

After the cleanup process, biotinylated λ-genomic DNA was mixed in 1:3 DNA:fluosphere ratio, in 600 mL total volume containing SB-100 buffer (1×TE, 100 mM NaCl, Tween-20, pH 8.0), at 6 rpm, 4° C. for 24 hours. DNA end was tried to label with different types of fluospheres like 200 nm neutravidin fluospheres (F8774, yellow-green fluorescent, Invitrogen) and 40 nm streptavidin transfluospheres (T10711, Red fluorescent, Invitrogen), with later ones being used in most of the experiments.

λ-DNA—*E. Coli* RNA Polymerase Holoenzyme (RNAP) Complex Formation

Fluosphere labeled λ-genomic DNA (75 μM) was mixed with *E. Coli* RNA polymerase holoenzyme (0.5 nM, S90050, Epicentre Biotechnologies) in presence of 5×CLB buffer (0.25 M HEPES-NaOH pH 8.0, 0.5 M NaCl, 25 mM $MgCl_2$, 25% glycerol) in a total volume of 50 μL. All reagents were mixed well using a pipette with wide opened tip to avoid DNA fragmentation. This solution was incubated at 37° C. for 15 minutes to form DNA-RNAP open complexes.

Then, 1 μL of 37% formaldehyde (F8775, Sigma Aldrich) was added to the above solution, mixed gently and incubated at 4° C. for 30 minutes. Formaldehyde reaction was quenched by adding 300 μL of OBS buffer (0.5×TBE (Sigma), 2.5% w/v poly n-vinylpyrrolidone (Sigma), 10% w/v glucose (Sigma) and 0.1% v/v Tween 20 (Sigma)] to this solution. Primary antibody-secondary antibody labeled quantum dot (AB-QD) complex solution (5 nM) prepared separately was added to the above solution of and allowed to mix slowly using rotation (6 rpm) at room temperature in a dark place for an hour.

AB-QD Complex Solution Preparation

Primary antibody (Mouse monoclonal, WP001 clone, specific to 13' sub-unit, Neoclone Biotech) was diluted from its stock concentration to a final concentration of 1 μM using 1×PBS, pH 7.2. Then, it was mixed with 1 μM quantum dots (Qdot 655 goat $F(ab')_2$ anti-mouse IgG conjugate H+L, Q11022MP, Invitrogen) in 1:1 ratio and incubated at room temperature in a dark place for 45 minutes. The obtained AB-QD solution was used to label RNAP molecules after formation of DNA-RNAP complexes.

Observation Solution

Above prepared DNA-RNAP-AB-QD complex solution was mixed with equal amounts of OBS buffer solution containing glucose oxidase (50 μg/mL, Sigma), catalase (10 μg/mL, Roche), β-mercaptoethanol (0.5% v/v, Sigma), and YOYO-I dye in DMSO (10 μM, 1:5 dye:base-pair ratio) and allowed to sit at room temperature for 10-15 minutes. This is to ensure proper mixing of dye molecules with the DNA molecules thereby ensuring uniform labeling.

Fluorescence Microscopy

Single molecule imaging was carried out using an inverted epi-fluorescence microscope (Leica DMI-4000B) with a 100× oil objective (plan-Apo, 1.4 N.A., Leica). An additional 1.6× magnifier was used to obtain a field of view of 54 $\mu m^2$. A mercury lamp was used as the fluorescence excitation source and a custom made filer (470/40 nm band-pass/585 nm dichroic/655/40 nm long-pass filter) was used. A split view system (488 nm band-pass/585 nm dichroic/655 nm long-pass filter, Optical Insights) was used to obtain two channel images for YOYO-I labeled DNA molecules (green) and the end labeled transfluospheres and RNAP labeled with QDs (Red). An electron-multiplied charge-coupled device (EMCCD, Ixon897, Andor) was used to acquire images with an equivalent pixel resolution of 100 nm.

Image Processing and Analysis

DNA length measurements and distance between end labeled fluosphere and RNAP molecules labeled with QD were carried out with ImageJ (NIH) software. First, the point spread function (PSF) for our optical setup was determined and images were iteratively deconvolved using a custom macro written in ImageJ. The deconvolved images were then cropped appropriately and applied with suitable threshold values. The thresholded image was used to obtain the distance between end labeled fluosphere and RNAP molecules labeled with QD. For this purpose, the "object tracker" plugin available in ImageJ software was used. This provided the distance between the end labeled fluosphere and the QD over "n" number of frames. Distance values from n-frames were averaged out to obtain the RNAP binding position.

Distance measurement results obtained in pixels from the above step were converted to values in μm. DNA contour length changes due to YOYO-I dye labeling (for 1:5 dye: base-pair ratio, the contour length increases from 16.5 μm to around 22 μm) and DNA stretching in nanoslits (In the experiments, around 87% DNA stretching was achieved in presence of applied electric field) were taken into account in calculating the final RNAP binding position values. All results were plotted into a histogram 2D Gaussian fitting of peaks were done using OriginPro 8.0.

Figure 9:
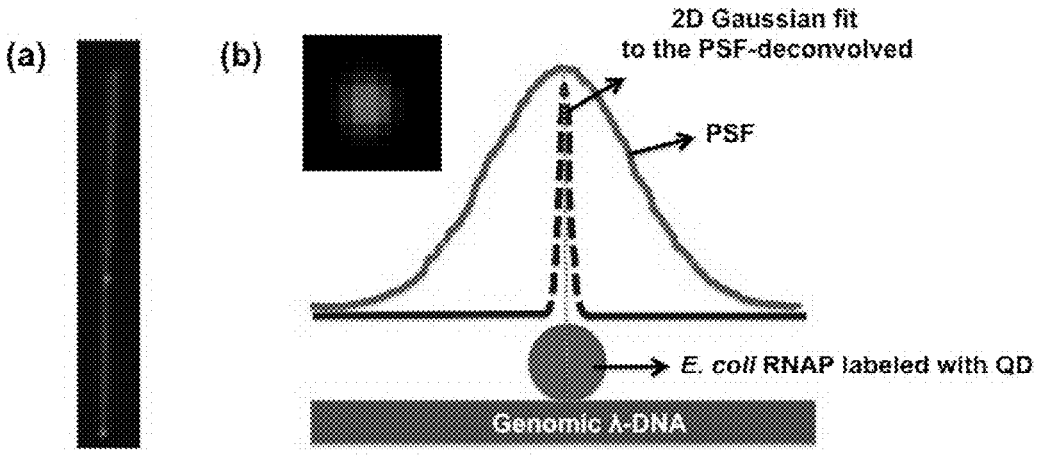
FIG. 9(*a*) shows a field stretched DNA molecule with QD labeled RNAP in image analysis.

FIG. 9(*a*) shows a field stretched DNA molecule with QD labeled RNAP in image analysis. FIG. 9(*b*) shows the concept of high resolution QD localization. A QD of around 15 nm sizes gives a point spread function comparable to its emission wavelength. The centroid co-ordinates can be obtained with greater precision using high-resolution localization method. Inset of FIG. 9(*b*) shows a single quantum dot. High precision localization of QDs obtained by deconvolving the collected distribution of photons to the point spread function of the system. Localization precision achieved using this method is 2.5 nm for a typical QD point spread function. The position co-ordinate values obtained from this localization were used in finding the distance between two quantum dots.

Many modifications and other embodiments of the present disclosure will come to mind to one skilled in the art to which the present disclosure pertains having the benefit of the teachings presented in the foregoing description. It will be apparent to those skilled in the art that variations and modifications of the present disclosure may be made without departing from the scope or spirit of the present disclosure. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The following references are incorporated in this application by reference.

REFERENCES

1. D. S. Latchman, Transcription factors: an overview, Int. J. Biochem. Cell Biol., Vol 29, No. 12, 1305-1312, (1997).
2. L. J. Guo, X. Cheng, C. F. Chou, Fabrication of Size-Controllable Nanofluidic Channels by Nanoimprinting and Its Application for DNA Stretching, Nano Lett., Vol 4, No. 1, 69-73, (2004).
3. J. Gu, R. Gupta, C. F. Chou, Q. Wei, F. Zenhausern, A simple polysilsesquioxane sealing of nanofluidic channels below 10 nm at room temperature, Lab Chip, Vol 7, 1198-1201, (2007).
4. Jan C. T. Eijkel and Albert Van Den Berg, Nanofluidics: what is it and what can we expect from it? Microfluid Nanofluid, Vol 1, 249-267, (2005).
5. Y. Harada, T. Funatsu, K. Murakami, Y. Nonoyama, A. Ishihama, T. Yanagida, Single molecule imaging of RNA polymerase-DNA interactions in real-time, Biophys J., Vol 76, 709-715, (1999).
6. Y. Ebenstein, N. Gassman, S. Kim, S. Weiss, Combining atomic force and fluorescence microscopy for analysis of quantum dot labeled protein-DNA complexes, J. Mol. Recognit, Vol 22, 397-402, (2009).
7. Yuval Ebenstein, N. Gassman, S. Kim, J. Antleman, Y. Kim, S. Ho, R. Samuel, S. Michalet, S. Weiss, Nanoletters, Vol 9, No. 4, 1598-1603, (2009).
8. T. T. Perkins, S. R. Quake, D. E. Smith, S. Chu, Relaxation of a single DNA molecule observed by optical microscopy, Science, Vol 264, 822-826, (1994).
9. C. Prinz, J. O. Tegenfeldt, R. H. Austin, E. C. Cox, J. C. Sturm, Bacterial chromosome extraction and isolation, Lab Chip, Vol 2, 207-212, (2002).
10. Massie, E. C.; Mills, G. I. ChIPping away at gene regulation. EMBO Rep. 2008, 9 (4), 337-343.
11. Ritort, F. Single-molecule experiments in biological physics: methods and applications J. Phys.: Condens. Matter 2006, 18, R531-R583. (4) Deniz, A. A.; Mukhopadhyay, S.; Lemke, E. A. Single-molecule biophysics: at the interface of biology, physics and chemistry J. R. Soc. Interface 2008, 5(18), 15-45.
12. Deniz, A. A.; Mukhopadhyay, S.; Lemke, E. A. Single-molecule biophysics: at the interface of biology, physics and chemistry J. R. Soc. Interface 2008, 5(18), 15-45.
13. Gueroui, Z.; Place, C.; Freyssingeas, E.; Berge, B. Observation by fluorescence microscopy of transcription on single combed DNA Proc. Natl. Acad. Sci. U.S.A. 2002, 99 (9), 6005-6010.
14. Tegenfeldt, J. O.; Prinz, C.; Cao, H.; Huang, R. L.; Austin, R. H.; Chou, S. Y.; Cox, E. C.; Sturm, J. C. Micro- and nanofluidics for DNA analysis Anal. Bioanal. Chem. 2004, 378(7), 1678-1692.
15. Wang, Y. M.; Tegenfeldt, J. O.; Reisner, W.; Riehn, R.; Guan, X. J.; Guo, L.; Golding, I.; Cox, E. C.; Sturm, J.; Austin, R. H. Single-molecule studies of repressor-DNA interactions show long-range interactions Proc. Natl. Acad. Sci. U.S.A. 2005, 102 (28), 9796-9801.
16. Blainey, P. C.; Oijen, A. M. V.; Banerjee, A.; Verdine, G. L.; Xie, X. S. A base-excision DNA-repair protein finds intrahelical lesion bases by fast sliding in contact with DNA Proc. Natl. Acad. Sci. U.S.A. 2006, 103(15), 5752-5757.
17. Kim, J. H.; Larson, R. G. Single-molecule analysis of 1D diffusion and transcription elongation of T7 RNA polymerase along individual stretched DNA molecules Nucleic Acids Res. 2007, 35 (11), 3848-3858.
18. Sanger, F.; Coulson, A. R.; Hong, G. F.; Hill, D. F.; Petersen, G. B. Nucleotide sequence of bacteriophage A DNA J. Mol. Biol. 1982, 162(4), 729-773.
19. Finn, R. D.; Orlova, E. V.; Gowen, B.; Buck, M.; Heel, M. V. *Escherichia coli* RNA polymerase core and holoenzyme structures EMBO J. 2000, 19(24), 6833-6844.
20. Hawley, D. K.; McClure, W. R. Compilation and analysis of *Escherichia coli* promoter DNA sequences Nucleic Acids Res. 1983, 11(8), 2237-2255.

21. Brodolin, K. Protein-DNA crosslinking with formaldehyde in vitro DNA-protein interactions: a practical approach, Oxford University Press 2000, Chapter 10, 141-149.

22. Bonthuis, D. J.; Meyer, C.; Stein, D.; Dekker, C. Conformation and dynamics of DNA confined in slitlike nanofluidic channels PRL 2008, 101(10), 108303.

23. Das, S. K.; Austin, M. D.; Akana, M. C.; Deshpande, P.; Cao, H.; Xiao, M. Single molecule linear analysis of DNA in nano-channel labeled with sequence specific fluorescent probes Nucleic Acids Res. 2010, 38 (18), e177.

24. Seong, G. H.; Niimi, T.; Yanagida, Y.; Kobatake, E.; Aizawa, M. Single-molecular AFM probing of specific DNA sequencing using RecA-promoted homologous pairing and strand exchange Anal. Chem. 2000, 72(6), 1288-1293.

25. Hou, X. M.; Zhang, X. H.; Wei, K. J.; Ji, C.; Dou, S. X.; Wang, W. C.; Li, M.; Wang, P. Y. Cisplatin induces loop structures and condensation of single DNA molecules Nucleic Acids Res. 2009, 37 (5), 1400-1410.

26. Ikeda, N.; Tanaka, N.; Yanagida, Y.; Hatsuzawa, T. On-chip single-cell lysis for extracting intracellular material Jpn. J. Appl. Phys. 2007, 46(9B), 6410-6414.

27. Yu, H.; Schwartz, D. C. Imaging and analysis of transcription on large, surface-mounted single template DNA molecules Anal Biochem. 2008, 380(1), 111-121.

What is claimed is:

1. A device for optical mapping of protein binding sites, comprising:

an insulating substrate, comprising two parallel channels and at least one slit connecting the two parallel channels;

a coverslip on the insulating substrate;

at least two reservoirs on the substrate connecting the two parallel channels of the insulating substrate, wherein one of the at least two reservoirs is formed from acrylic material; and at least two electrodes in the at least two reservoirs so that when the at least two reservoirs are filled with a buffer solution, the at least two electrodes are in electrical contact in the buffer solution.

2. The device of claim 1, wherein the insulating substrate is a fused silica substrate or oxidized silicon substrate.

3. The device of claim 1, wherein the two parallel channels are each 100 μm in width and 1 μm in depth.

4. The device of claim 1, wherein the at least one slit is 200 μM in length, 10 μm in width and 60 nm in depth.

5. The device of claim 1, wherein the coverslip comprises a glass coated with polysilsesquioxane.

6. The device of claim 1, wherein the insulating substrate has a surface area of 14 $mm^2$.

7. The device of claim 1, further comprising two positive electrodes and two negative electrodes.

8. A method for optical mapping of protein binding sites, the method comprising:

using a device comprising:

an insulating substrate, comprising two parallel channels and at least one slit connecting the two parallel channels;

a coverslip on the insulating substrate;

at least two reservoirs on the substrate connecting the two channels of the insulating substrate, wherein one of the at least two reservoirs is formed from acrylic material; and at least two electrodes in the at least two reservoirs so that when the at least two reservoirs are filled with a buffer solution, the at least two electrodes are in electrical contact in the buffer solution, wherein the using the device comprises:

providing a DNA-protein complex labeled with fluospheres in a buffer solution;

applying the buffer solution into the at least two reservoir so that the two parallel channels are filled with the buffer solution;

applying a voltage drop across the two parallel channels;

applying a voltage drop across the at least one slit so that the DNA-protein complex labeled with fluospheres is trapped in the at least one slit; and analyzing protein binding sites on the DNA-protein complex by a fluorescence microscope.

9. The method of claim 8, wherein the analyzing results in a 100 nm resolution of the protein binding sites.

10. The method of claim 8, wherein the DNA of the DNA-protein complex is λ-DNA.

11. The method of claim 8, wherein the protein of the DNA-protein complex is transcription factors.

12. The method of claim 8, wherein the protein of the DNA-protein complex is *E. coli* RNA polymerase holoenzyme.

13. The method of claim 8, further comprising ligating biotin to the DNA of the DNA-protein complex.

14. The method of claim 8, further comprising removing unbound oligonucleotides.

15. The method of claim 8, wherein the fluospheres are 40 nm streptavidin transfluospheres.

16. The method of claim 8, wherein the fluospheres are 200 nm neutravidin fluospheres.

* * * * *